US008640880B2

(12) United States Patent
Farwick

(10) Patent No.: US 8,640,880 B2
(45) Date of Patent: Feb. 4, 2014

(54) SCREENING MACHINE

(75) Inventor: Andreas Farwick, Oelde (DE)

(73) Assignee: TERRA SELECT GmbH & Co. KG, Sassenberg (DE)

( * ) Notice: Subject to any disclaimer, the term of this patent is extended or adjusted under 35 U.S.C. 154(b) by 0 days.

(21) Appl. No.: 13/490,930

(22) Filed: Jun. 7, 2012

(65) Prior Publication Data

US 2012/0312724 A1 Dec. 13, 2012

(30) Foreign Application Priority Data

Jun. 7, 2011 (DE) ..... 10 2011 104 860

(51) Int. Cl.
*B07B 13/00* (2006.01)
*B07C 5/12* (2006.01)

(52) U.S. Cl.
USPC ..... 209/671; 209/672

(58) Field of Classification Search
USPC ..... 209/667, 670, 671, 672
See application file for complete search history.

(56) References Cited

U.S. PATENT DOCUMENTS 4,703,860 A * 11/1987 Gobel et al. ..... 209/672
5,051,172 A * 9/1991 Gilmore ..... 209/672
6,250,477 B1 * 6/2001 Swanink ..... 209/386

FOREIGN PATENT DOCUMENTS

GB 2072049 A * 9/1981

* cited by examiner

*Primary Examiner* — David H Bollinger
(74) *Attorney, Agent, or Firm* — Greer, Burns & Crain, Ltd.

(57) ABSTRACT

A screening machine is provided with a screening device and a screening device with multiple adjacent screen shafts disposed rotatable each of which being provided with a plurality of screen disks. The screen disks are made of rigid materials and are separated from one another in the axial direction by a clearance each. The screen disks of a screen shaft engage in clearances of the screen disks of adjacent screen shafts. Half of the screen disks are provided with a cleaning device for cleaning the clearances between the screen disks.

20 Claims, 5 Drawing Sheets

SCREENING MACHINE

BACKGROUND

The present invention relates to a screening device and a screening machine having a screening device for screening in particular biomass and similar bulk goods or the like. The screening machine and the screening device can be employed for a great variety of purposes. One possible field of application is the screening of biomass for thermal processing. The burning of biomass for generating heat or energy requires screening of the biomass provided so as to feed the desired useful grain fraction to the incinerator wherein for example sand or the like particles are first sifted out to reduce e.g. the ash content. It may furthermore be useful to sort out too large pieces so as to ensure a homogeneous, even incineration or prevent interferences in the conveyor devices of incinerators.

Similar conditions apply to other applications so as to render it useful to split the mass to be screened into two, three or more fractions one of which is processed further while waste materials such as sand or the like are for example immediately dumped. Any too large pieces can be chopped or shredded further and screened once again.

Screening biomass is for example carried out employing star screens where screen shafts aligned in parallel have screen stars attached on them which consist of elastic materials and comprise screen fingers extending radially outwardly from the shaft. Due to the elasticity of the screen fingers each finger can deflect resiliently as needed. The screen stars of a screen shaft each engage in clearances between the screen stars of an adjacent screen shaft. In operation the screen shafts rotate, thus conveying the material to be screened along the screen deck. Material to be screened gets between the screen fingers and is conveyed downwardly beneath the screen deck primarily by way of the screen stars rotating if the material received between the fingers is small enough.

These star screens having screen stars of elastic materials operate reliably. It is a drawback though that each of the screen star fingers requires a certain spatial extension to ensure the required stability. Therefore star screens of elastic materials cannot be used for screening fine and ultrafine biomass components.

Disk screens or disk separators have become known in the prior art in which multiple shafts are provided disposed in parallel in a rack and drivable non-rotatably on which multiple disks are arranged spaced apart and interdigitated. Such a disk screen has become known for example from EP 0861696 A1. In this known disk screen or disk separator the polygonal disks disposed on the shafts consist of a ferrous material. Parts of the disk body surfaces are provided with a hard-metal armor to prolong service life.

This known disk screen is thus basically also suitable for separating difficult-to-screen masses. Biomass tends to be a difficult-to-screen substance and moreover, being a cohesive screen feed, tends to cake and accumulate on the disks or the shaft hubs.

Metal screen disks allow selective screening of fine products. There is the drawback though that the screening of cohesive materials may involve increased caking of the screen feed on the disks and/or shaft hubs which may result in reduced screening output and possible blocking of the screen if more operating energy is required than operating energy is available.

Therefore it has become known in EP 0861696 A1 to provide every other tip of each disk with a laterally protruding scraper to clear caking from the clearance between the disks and the shaft hub surface during the rotary movement of the disks. This prior art is basically functional. There is the drawback, however, that the large quantity of 5 scrapers per disk involves high energy requirement for the rotational movement of the disk screens since the scrapers must continuously pass through the screened mass. Moreover caking may occur if fine, cohesive materials are screened.

SUMMARY

It is therefore the object of the present invention to provide a screening device and a screening machine having a screening device which allows selective screening of small-grain fractions and wherein cleaning means are provided for cleaning the clearances between adjacent screen disks and moreover involving reduced energy requirement.

The screening device according to the invention comprises multiple adjacent screen shafts arranged rotatable each of which having arranged thereon a plurality of screen disks of substantially rigid materials. The screen disks are separated from one another in the axial direction by a clearance each.

Screen disks of a screen shaft engage in clearances of the screen disks of adjacent screen shafts. About half of the screen disks are provided with at least one cleaning device for cleaning the clearances between the screen disks of adjacent screen shafts.

The screening device according to the invention has many advantages. A considerable advantage of the screening device according to the invention is that the screen disks consist of substantially rigid materials. While the screen disks preferably consist of metallic materials, they may be of non-elastic plastics. The structure of rigid materials allows to ensure greater precision in construction which also allows to screen fine and ultrafine biomass fractions. Each screen disk and each cleaning device maybe be substantially made of a single rigid material.

Any materials adhering to the screen disks or the screen shaft are removed by the cleaning devices disposed on about half of the screen disks. The cleaning device preferably comprises, or is configured as, at least one and in particular exactly one extended cleaning tooth. In particular exactly every second screen disk is provided with exactly one extended cleaning tooth for cleaning the clearances between the screen disks of adjacent screen shafts.

The extended cleaning tooth allows a nearly allover cleaning of the screen disk sides. The axial width of the cleaning tooth is preferably at least twice the axial thickness of the screen disk and in particular more than thrice the screen thickness. In particular the terminal screen disks of a screen shaft may be provided with cleaning teeth being narrower in their axial width.

Or else it is conceivable for one cleaning device to comprise two or more extended cleaning teeth. The at least two cleaning teeth are preferably arranged on the screen disk at offset angles. Providing two cleaning teeth allows for each cleaning tooth to substantially protrude from one side of the screen disk only. Also at least one cleaning tooth of the at least two cleaning teeth may be positioned axially non-centered to the screen disk. Thus the cleaning tooth protrudes by a larger area on one side of the screen disk.

In particular the at least two extended cleaning teeth of a screen disk are positioned such that they substantially cover the clearance to be cleaned between the screen disks of adjacent screen shafts. This configuration involving two substantially half cleaning teeth is particularly advantageous because the at least two cleaning teeth supplement each other's cleaning effect and in this way reduce the loads acting on a single cleaning tooth. This also allows greater ease in urging any foreign bodies out of the clearances between the screen disks of adjacent screen shafts. In particular is any blocking of individual screen shafts or of the entire screening device reliably avoided.

Due to the rigid materials the screen disks employed may show thinner wall thicknesses relative to the known screen stars of elastic materials. Given the same particle-size fraction a considerably larger open screen surface is obtained. Additionally finer screening results can be achieved as well as a higher throughput involving a comparable screen surface.

Preferably the screen disks of the screening device are arranged rotatable in the same sense. In this way the screened material is conveyed off the feeding point while being screened simultaneously.

The fact that the cleaning means provided at every second screen disk is one cleaning device only in particular with only one cleaning tooth, considerably reduces energy consumption in operation. Two screen disks are provided with one cleaning tooth only between them or only two substantially half-size cleaning teeth while the cited prior art provides two screen disks with a total of 10 scrapers which must continuously pass through the screened mass.

Particularly preferably the cleaning devices are only provided at the screen disks of about half of the screen shafts. This means that given an even number of screen shafts exactly half of the screen shafts are provided with cleaning device. Since cleaning devices are provided at every second screen shaft only, each of the screen disks of the respective screen shaft is provided with cleaning devices while the screen disks of the other half of the screen shafts do not comprise any cleaning devices. The screening device or at least one screen unit maybe provided with multiple adjacent screen shafts wherein the screen disks at both ends are not provided with cleaning devices while the center screen shafts are provided with cleaning devices.

With the total number of screen shafts being an uneven number, the number of screen shafts equipped with screen disks having cleaning devices may correspond to the number of half the total screen shafts rounded off upwardly or downwardly.

Correspondingly the total number of the screen disks provided with cleaning devices may be somewhat above or somewhat below half the total number of screen disks.

Particularly preferably, screening devices having an even number of screen shafts are provided such that the number of screen disks provided with cleaning devices is 50%+/−5% and in particular exactly 50%.

In a preferred specific embodiment at least one screen unit is provided comprising multiple adjacent and in particular four adjacent screen shafts. A screen unit comprising four adjacent screen shafts preferably has only the screen disks of the two center screen shafts equipped with cleaning devices. This configuration offers considerable advantages since the cleaning devices of the screen disks of the two center screen shafts can clean all the clearances of the screen unit. The rotation of the cleaning devices causes the clearances between screen disks of the outer screen shafts to be cleaned also.

Adjacent screen shafts of a screen unit advantageously rotate at different speeds. By way of different speeds of rotation in operation of adjacent screen shafts of a screen unit it is ensured that the cleaning device will not always swipe the same spot but the cleaning device will during operation clean the clearance between pairs of screen disks over the entire circumference. The different speeds of rotation cause the cleaning device to clean a different peripheral spot of the clearance concerned in every rotation. After a few rotations of the screen shafts the entire periphery will be cleaned so as to reliably prevent cohesive product from building up layers.

The consequent cleaning of the clearances furthermore ensures a consistent screening output during operation and the screened-grain distribution of the screened-out fraction is largely consistent. Preferably multiple adjacent screen shafts of one or more screen units are coupled for driving. The individual screen shafts may for example be interconnected via chain drives. The numbers of teeth of the individual sprockets allow to ensure defined speed ratios of the screen shafts relative to one another. A chain drive simultaneously avoids slippage so as to ensure defined angular positions between screen shafts at all times. This ensures that the cleaning devices of the two adjacent center screen shafts do not collide.

The dimensions of the extended cleaning teeth are matched to the speed ratios of the adjacent screen shafts so as to ensure the most complete possible cleaning of the clearance between pairs of screen disks, while at the same time preventing collisions of the cleaning teeth of adjacent screen shafts.

It has been found that a speed ratio between two adjacent screen shafts of a screen unit between 7:6 and 5:2 is advantageous. Particularly preferably a fixed speed ratio of 4:3 is set. This ensures that the pairs of meshing cleaning devices of the center screen shafts reach behind one another as they are closest to one another. Given a speed ratio of 4:3, the same constellation will occur once in every 4 or 3 rotations.

In all of the configurations, it is preferred for the rotational speeds of the screen shafts to increase or decrease in the conveying direction of the screen feed to be screened. For example the screen shafts of a second screen unit may show higher rotational speeds than do the screen shafts of a first screen unit wherein the speed ratios of each of the screen shafts in each of the screen units may remain constant.

An increasing rotational speed of the screen shafts in the conveying direction of the screening device may be useful for example for achieving consistent screening results across the screen surface. The feeding area of the screening device will as a rule contain a higher quantity of infeed materials such that the screened-out materials are rather finer there than at the end of the screen line where, given identical speeds of rotation, the fine materials will be somewhat coarser. To counter this, the shaft rotation rate may increase from the beginning of the screen line towards the end. In the case of other materials or constellations, the same speeds of rotation or even reduced speeds of rotation may be useful. Varying the rotational speed over the length of the screen allows compensation for these factors.

In all of the configurations, it is preferred for the screen disks and/or the cleaning devices to consist of metal. Preferably the cleaning devices and/or the cleaning teeth comprise at least one armored coat to reduce wear. Suitable plastic or ceramic materials are likewise possible.

In all of the configurations it is possible for at least one screen disk to comprise at least one lateral recess and/or at least one axial through hole. Axial through holes in at least one screen disk may reduce any caking at the screen disks. Moreover the total weight of the screening device is quite considerably reduced. This is an advantage in particular in—though not limited to—transportable screening devices or screening machines. Moreover the rotating mass is reduced so as to reduce loads on the driving and bearing components. This is why reduced energy requirement is realized as well.

Advantageously at least one screen shaft is configured as a multi-edge and in particular a square tube.

At least one screen shaft may comprise an inner, solid screen shaft and an outer tube or an outer screen tube. In assembly the outer screen tube is pushed onto the inner screen shaft. The inner cross-section of the outer screen tube is mated to the outer cross-section of the inner screen tube to ensure form-fit. Some play is possible to ensure ease of pushing on. For example an absolute difference between the inner dimension of the outer screen tube to the outer dimension of the inner screen tube of 0.5 mm or 1 mm or 2 mm or the like may be provided. It is also possible and preferred for the inner dimensions of the outer screen tube to be larger by approximately 1% to 10% and in particular by approximately 2% to 5% than the outer dimensions of the inner screen tube. The screen disks are preferably attached to the outer screen tube prior to pushing it on.

The multi-edge tube has the associated screen disks fastened to it. The screen disks may for example be retained at the multi-edge tube by way of form-fit. Additionally they may for example be welded to the multi-edge tube.

In all of the configurations, it is preferred for at least one screen shaft to be provided with multiple mounting aids in defined positions in the axial direction. Such mounting aid may for example be configured as a groove or comprise a circumferential ridge or a hole, a recess or an elevation or the like. Preferably the screen disks are aligned by or disposed at the mounting aids. Particularly preferably, the screen disks form bayonet joints with the mounting aids and/or the screen shafts. The bayonet joint retains the screen disk at the screen shaft in a defined way. Preferably at least one sleeve is disposed in the clearance between pairs of screen disks of a screen shaft. The sleeve is in particular firmly connected with, and preferably welded to, a screen disk. The sleeve in particular surrounds the multi-edge shaft and serves to prevent screened materials from adhering to the multi-edge shaft. The sleeve may for example have a round outer cross-section. It is also possible and preferred for the outer contour of at least one sleeve to be adapted to the movement profile of the cleaning devices. The movement profile of the cleaning devices depends in particular on the rotation ratio of adjacent shafts and may for example be configured as a rounded triangle or rounded square. Rounded multi-edge outer contours may be provided as well depending on the speed ratio.

The sleeves may for example consist of stainless steel. Stainless steel as a rule offers the advantage of poor adhering properties with biomass. Or else it is possible to manufacture the sleeve of other plastic or natural materials. It is also possible for the sleeve to consist of a first material and to have an outer coat of a second material. Or else an additional Teflon or the like coating is conceivable.

In all the specific embodiments and configurations, it is preferred for the screen disk to be provided with a deflector preceding the cleaning device in the peripheral direction. Such a deflector will as a rule prevent, for example foreign bodies such as stones or the like from jamming the cleaning device since the deflector will first contact such foreign body and thus move it away. This further increases the reliability of the system.

In all the configurations, it is preferred for at least one screen disk to be configured as a toothed disk comprising teeth protruding radially outwardly. The teeth of the toothed disk serve for conveying the screened product along the screen surface and cause loosening and spreading the screened product.

In all the configurations, it is preferred for the lateral end shafts of the screening device to not be provided with cleaning devices. Such a configuration allows a modular structure since with two screening devices mounted to one screening machine the cleaning devices of one screen unit will not protrude between the screen disks of the adjacent screen unit. Since the cleaning devices have a lateral distance of only approximately 1 or 2 or 3 mm from the adjacent screen disk while the clearance between pairs of screen disks is for example 10 or 15 mm, this allows considerably easier mounting of multiple screen units relative to one another since mounting does not require an accuracy of 1 millimeter but only an accuracy of for example 5 millimeters. At the same time the screening accuracy on the surface is maintained since there the narrow, precise gap dimensions are observed. Because no cleaning devices are provided at the lateral end shafts, there can consequently not occur any collision of cleaning devices if multiple screen units are mounted in series.

According to another aspect of the invention, it is the object to provide a screening device which comprises screen disks at rotating screen shafts and allows high reproducibility of structure and assembly.

The background of this object is that the screen disks employed tend to consist of heavy metal plates of a nominal sheet thickness of for example 3 or 4 millimeters wherein tolerances of the sheets used allow considerable deviations from the nominal sheet thickness. This results in screen shafts having a plurality of for example 40, 50, 60 or more screen disks showing different dimensions and require extensive adaptation and matching.

The described object is solved by a screening device comprising multiple adjacent screen shafts which rotate in operation. Each of the screen shafts has a plurality of screen disks spaced apart from one another in the axial direction by clearances. Screen disks of a screen shaft engage in the clearances of the screen disks of an adjacent screen shaft. Predefined axial positions of at least one screen shaft are provided with at least one mounting aid each for defined mounting of the screen disks. The axial positions on the screen shaft are defined by an integer multiple of an axial distance starting at a point of origin.

The screening device according to the invention has many advantages. One considerable advantage of this screening device according to the invention consists in avoiding added-up errors. The mounting positions of each of the screen disks are defined by a respective distance that in turn is defined by an integer multiple of an axial distance from a point of origin. This means that each position is first calculated relative to a point of origin so as to reliably avoid a plurality of added-up tolerances.

In contrast to this, the prior art provides for a first screen disk to be mounted on the screen shaft. Thereafter, a spacer is mounted and a second screen disk is pushed on. Following this, screen disks are mounted alternating with spacers with the screen disk positions ensuing by way of the added-up axial dimensions of all of the components pushed on. Even if every single component shows high manufacturing accuracy, said manufacturing accuracy always includes tolerances such that a number of "n" components pushed on results in an n-fold tolerance. In the case of 60 screen disks and given minimal manufacturing tolerances of e.g. 1/10 millimeter, this may result in a conceivable error of 6 millimeters. Now if the screen disks of a first screen shaft are intended to be pushed between the screen disks of a second screen shaft, then the clearances between screen disks must be fitted manually, which renders manufacturing complicated and expensive.

The invention in turn provides a screening device in which the adding up of various tolerances, errors and manufacturing inaccuracies is basically avoided. The measuring and positioning of each screen disk does not occur by positioning by the previously mounted screen disks but absolutely, from a point of origin every time. In this way the lateral distance of a screen disk from an axial end of the screen shaft amounts to a basic distance and added thereto, the n-fold distance between pairs of screen disks. The maximum error is exactly one thickness tolerance of the screen disk but not 60 times the tolerance of a screen disk in the case of e.g. 60 screen disks provided.

In all the configurations, the mounting aid preferably comprises at least one groove in the screen shaft and in particular in the outer screen shaft or in the outer multi-edge tube. The groove may be configured circumferential around the screen shaft. Or else it is possible and preferred for the mounting aid to comprise single depressions, grooves or holes on the circumference of the screen shaft. If for example a groove, a hole or the like is employed as a mounting aid, then all of the holes or grooves intended as mounting aids may be worked into the screen shaft prior to mounting the screen disks. This may be done for example in an automated manufacturing process in which respective markings or grooves or the like are worked into the screen shaft laser-assisted.

Preferably, at least one screen disk is provided with a holding finger which engages the screen shaft groove. This configuration allows for particularly reliable mounting since the holding finger engaging the groove results in a permanently defined, both axial and radial positioning of the screen disk.

In all the configurations, it is preferred for the screen disk to interact with the mounting aid of the screen shaft by way of a bayonet joint.

In advantageous configurations the screen disk is provided with at least one supporting finger which serves as a support on the outer screen shaft.

Preferably, an outer screen shaft and an inner screen shaft are provided with the inner screen shaft configured solid and the outer screen shaft, being a screen tube, pushed onto the inner screen shaft. To this end, the inner cross-section of the outer screen tube is mated to the outer cross-section of the inner screen shaft. Multi-edge profiles such as a square are preferred.

Given such a configuration, the holding fingers engage in the mounting aids which are for example configured as a groove or a hole in the outer screen tube, without penetrating inwardly all through the wall. In this way it is ensured that the outer screen tube can be pushed onto the inner screen shaft.

In all the configurations, it is preferred for a screening machine to be equipped with at least one of the screening devices described above.

BRIEF DESCRIPTION OF THE DRAWINGS

Further advantages and features of the present invention can be taken from the exemplary embodiments which will be discussed below with reference to the enclosed figures.

The figures show in.

DETAILED DESCRIPTION

With reference to the enclosed FIGS. 1-12, by way of the following exemplary embodiments, screening machines 100 will be described having screening devices 1 according to the invention each being configured as a toothed disk screen 105.

Figure 1:
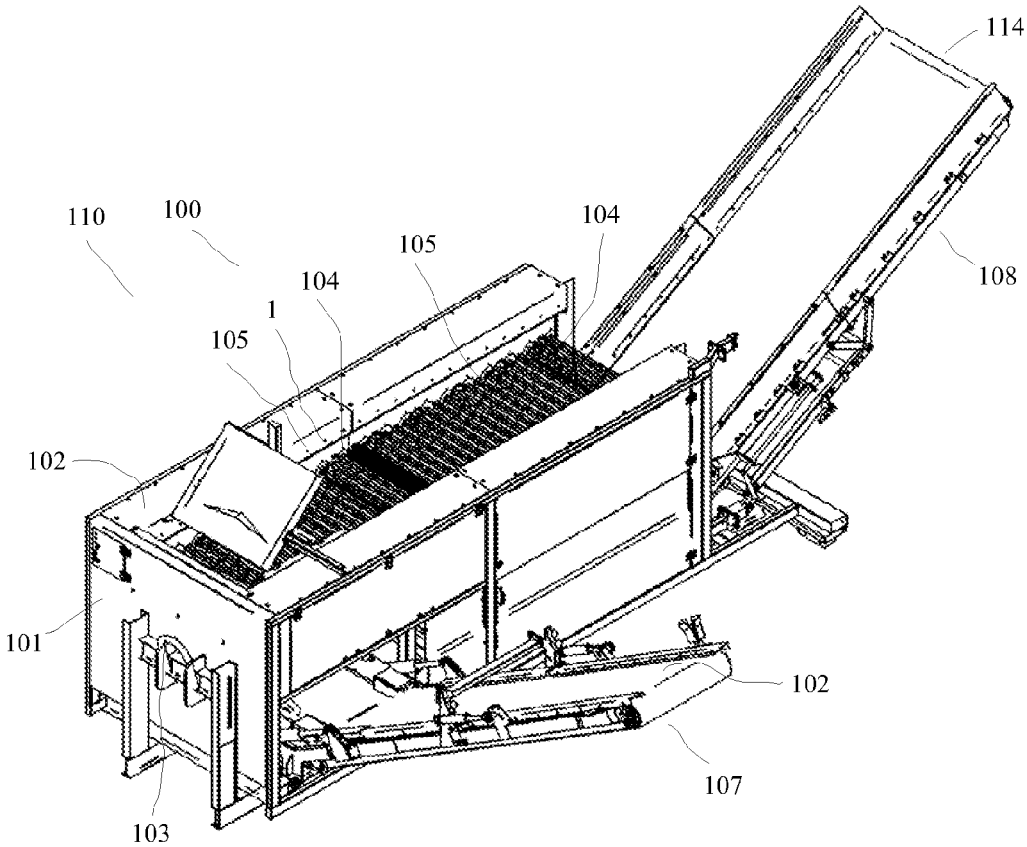
FIG. 1 a perspective view of a transportable screening machine according to the invention.

FIG. 1 shows a perspective view of a screening machine 100 configured as a mobile screening machine 110 which can be gripped by handling hooks 103 for transporting the screening machine 100 for example by truck. The transportable screening machine 110 may be provided with wheels, being configured as a trailer or an automotive vehicle.

The screening machine 110 in FIG. 1 comprises a screen deck 104 with two toothed disk screens 105. The first toothed disk screen 105 is positioned in the feeding area which follows the feeding hopper 102. The screen deck 104 has another toothed disk screen 105 following downstream. The toothed disk screen 105 serves for screening out sand and the like particles from the screened mass or biomass. The screened out fine material 112 drops downwardly and is conveyed off via the discharging belt 107.

The screen shafts not illustrated in detail in FIG. 1 with the screen disks 8 and 9 of the toothed disk screen 105 arranged thereon conveys the deposited material away from the feeding hopper 102 while the fine materials 112 are sifted out.

At the end of the second toothed disk screen 105 the coarse materials 114 are fed onto the discharging belt 108 and conveyed off.

Figure 2:
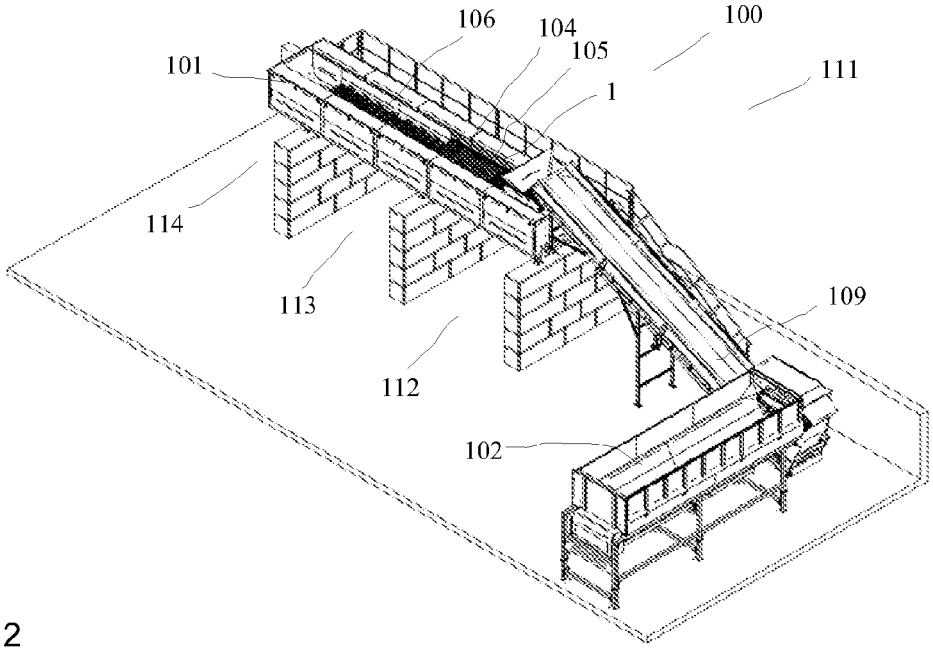
FIG. 2 a perspective view of a stationary screening machine according to the invention.

FIG. 2 illustrates a simplistic, perspective view of a screening machine 100 configured as a stationary screening machine 1. The materials to be screened are fed for example from a wheeled loader into the feeding hopper 102 and via the conveyor belt 109 gets onto the screen deck 104 which is equipped with a toothed disk screen 105 representing the screening device 1. The toothed disk screen 105 will be discussed in more detail with reference to the following figures.

In the first part of the screening machine 111 the fine materials 112 such as sand and the like pass through the toothed disk screen 105 downwardly where they can be removed for example with another wheeled loader or the like. The usable fraction is screened out in the second part while the overlarge coarse materials 114 are removed at the end.

The housing 101 of the screening machine 100 can basically be configured as desired.

Figure 3:
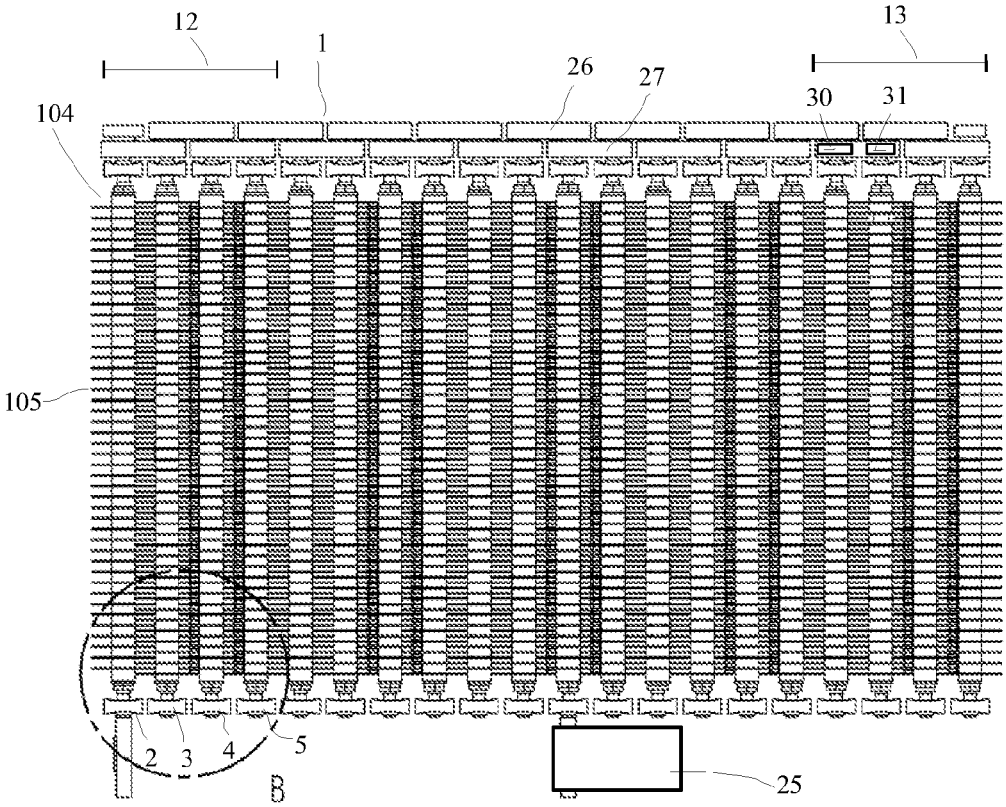
FIG. 3 a screen deck of the screening machine according to FIG. 1 or FIG. 2.

FIG. 3 shows an enlarged top view of the screen deck 104 of the screening machines in FIG. 1 and FIG. 2 configured as a toothed disk screen 105. The toothed disk screen 105 comprises a plurality of screen shafts 2-5 disposed in parallel relative to one another. Each of the screen shafts 2-5 is equipped with a plurality of screen disks 8 or 9 which are provided axially spaced apart on the screen shafts 2-5.

A schematically indicated motor 25 serves for driving. The individual screen shafts are non-rotatably coupled with one another by means of sprockets 30, 31 and chains 26, 27. Two or more motors may be provided.

The toothed disk screen 105 consists of multiple screen units 12 or 13 which are mounted in series in the conveying direction of the screened materials.

Figure 4:
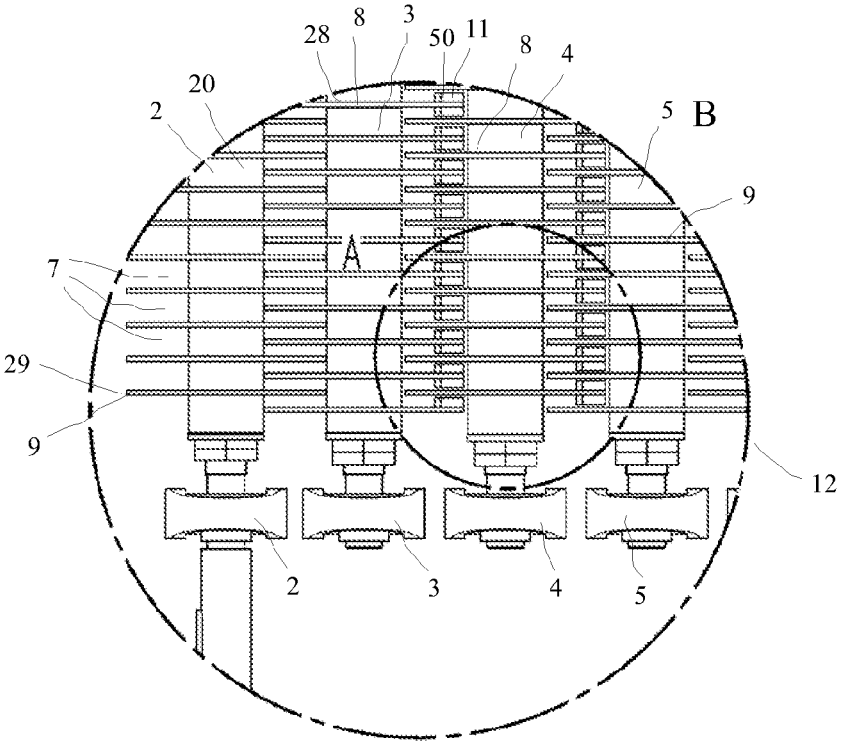
FIG. 4 enlarged detail B from FIG. 3.

FIG. 4 shows the detail "B" from FIG. 3 in a further enlarged view. The total of four shafts 2-5 of the screen unit 12 are illustrated. The screen shafts 2 and 5 are equipped with screen disks 9 which are configured as toothed disks 29. The center screen shafts 3 and 4 are provided with screen disks 8 which are configured as toothed disks 28. Clearances 7 are provided between each of the screen disks 8 or 9 of each of the screen shafts 2-5 in the axial direction of the shafts, into which the adjacent screen disks 8 or 9 of the adjacent screen shafts enter.

Cleaning devices 50 are provided for removing caking from the surfaces of the screen disks 8 and 9 and the surfaces of the screen shafts. A cleaning device 50 presently comprises a cleaning tooth 11 as the cleaning means 10. The cleaning teeth 11 are only disposed at the screen disks 8 of the center screen shafts 3 and 4. Each of the screen disks 8 of the center screen shafts 3 and 4 is provided with exactly one cleaning tooth 11. The screen disks 9 of the outwardly screen shafts 2 and 5 are not provided with cleaning teeth.

Due to this construction, basically any desired quantity of screen units 12 can readily be mounted in series to provide a screen surface of the desired size. The fact that the screen disks 9 of the screen shafts 2 and 5 are not equipped with cleaning teeth 11 eliminates any risk of the cleaning teeth 11 of adjacent screen units 12 colliding when adjacent screen units 12 are mounted. The requirements of mounting accuracy are considerably reduced without affecting the screening results in practice. Moreover, adjacent screen units 12 can be operated at different speeds.

In the position illustrated in FIG. 4 the cleaning teeth 11 clean the clearances 7 at the screen shaft 2 and the screen shaft 5. In operation the screen shafts 2-5 continue to rotate such that during the continued rotation the cleaning teeth 11 clean the clearances 7 at the screen shafts 2 and 3. In rotating operation the cleaning teeth 11 of the screen shaft 3 clean the clearances of the screen shafts 2 and 4. In rotating operation the cleaning teeth 11 of the screen shaft 4 clean the clearances 7 of the screen shafts 3 and 5. In this way it is ensured that all of the clearances 7 of the screen unit 12 are cleaned in the course of a few rotations of the screen shafts 2-5. In case that screened product should deposit on the surfaces of the screen disks 8 and 9 or the sleeves 20, such caking will be removed in the course of a few rotations.

Figure 5:
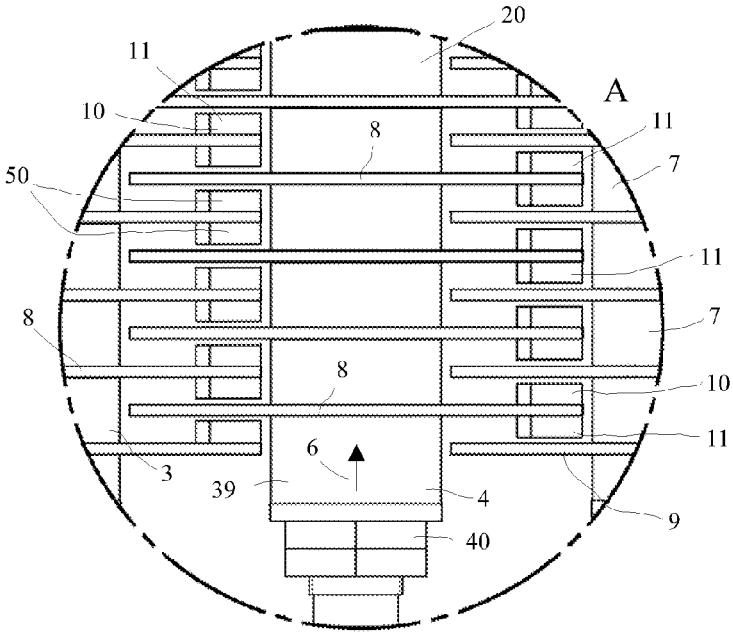
FIG. 5 enlarged detail A from FIG. 4.

The detail "A" in FIG. 4 is shown in FIG. 5. The screen shaft 4 is illustrated with, disposed thereon, the screen disks 8 equipped with cleaning teeth 11. The cleaning teeth 11 serving as cleaning means 10 leave only narrow axial distances between the screen disks 9 and the cleaning teeth 11 so as to ensure reliable cleaning.

The screen disks 8 and 9 are disposed with defined clearances in-between in the axial direction 6.

Figure 6:
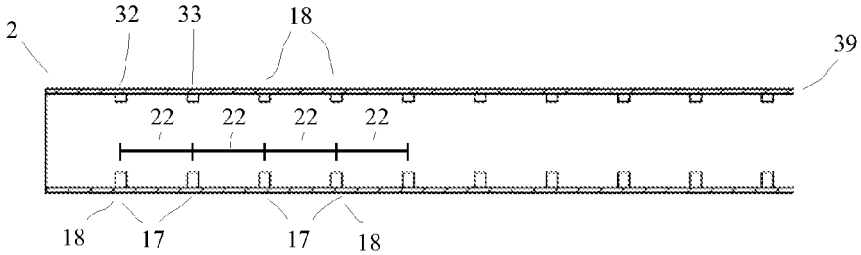
FIG. 6 a schematic longitudinal sectional view of an outer screen shaft.

FIG. 6 shows the outer shaft tube 39 for example of the screen shaft 2. The outer shaft tube 39 comprises mounting aids 17 in the shape of holes or grooves 18 provided at the presently four corners of the square profile. The mounting aids are positioned at equal axial distances 22 from one another. The outer shaft tube 39 is configured as a multi-edge tube 15 and presently as a square tube 16 and may serve as the outer shaft tube of the shafts 2-5.

The inner shaft tubes 40 of each of the screen tubes 2-5 comprise an outer contour mating with the inner contour of the outer shaft tube 39 so as to generate form-fit when the outer shaft tube 39 is pushed onto the inner screen shaft 40 that is configured solid.

Figure 7:
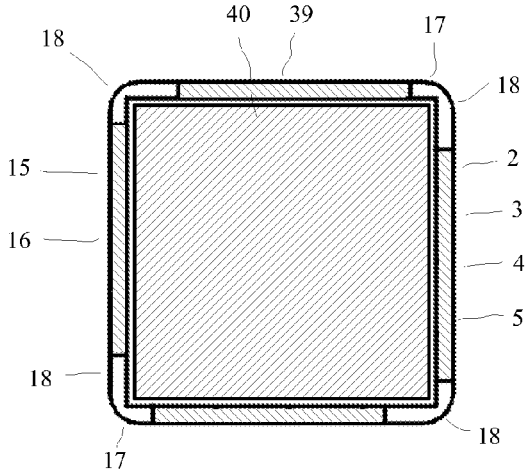
FIG. 7 an enlarged cross-section of the screen shaft according to FIG. 6.

FIG. 7 illustrates a cross-section of the outer screen shaft or the outer shaft tube 39 from FIG. 6. When mounted, the outer shaft tube 39 is received by the inner shaft tube or the inner screen shaft 40.

Figure 8:
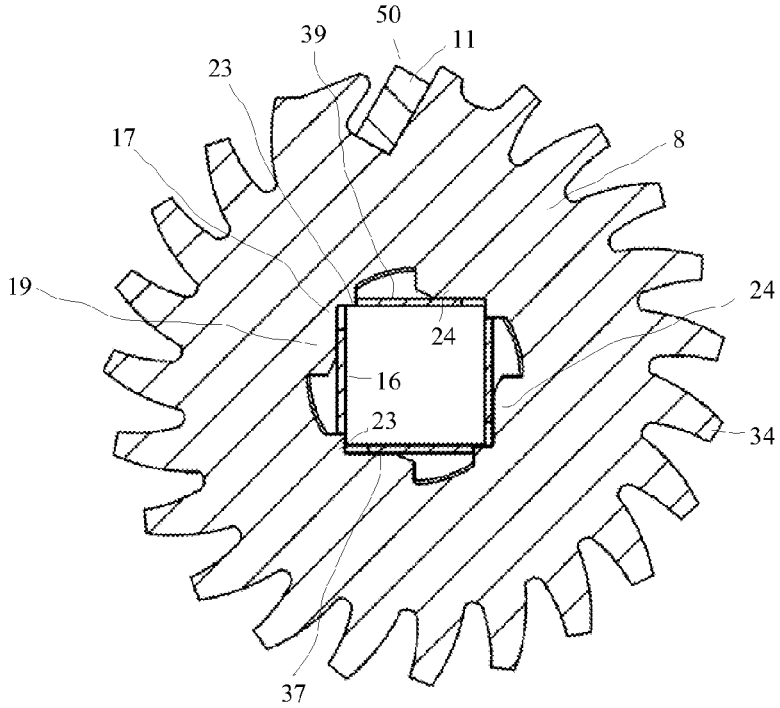
FIG. 8 a cross-section of a screen disk and the screen shaft.

FIG. 8 shows a screen disk 8 which is connected with the outer shaft tube 39.

The inner contour of the toothed disk 8 (and of the toothed disk 9 also) is provided with holding fingers 23 and supporting fingers 24. After pushing a toothed disk 8 or 9 onto the outer shaft tube 39 and positioning at the mounting aid 17 in the form of the grooves 18 the toothed disk 8 is rotated approximately 20 degrees, presently clockwise, until the holding fingers 23 engage the grooves 18 serving as mounting aid 17. The holding fingers 23 are dimensioned such that they do not or only very slightly protrude inwardly. This allows ease of pushing them onto the inner screen shaft.

If the holding fingers 23 were to protrude further inwardly, then e.g. longitudinal grooves might be provided on the outer surface of the inner screen shaft to allow pushing the outer shaft tube 39 onto the inner shaft tube.

At any rate the mounting aids 17 ensure a firm seat of the toothed disk 8 both in the axial and radial directions in a defined and in particular predefined position. By way of the rotary movement of the toothed disk 8 or 9 by approximately 20 degrees the supporting finger 24 bears against the outside of the outer tube 39 where it is supported.

Following such positioning the toothed disk 8 or 9 is welded to the outer tube 39 by means of a welding seam 37.

In operation the toothed disks 8 rotate counterclockwise in the orientation according to FIG. 8 so as to transmit the loads applied by the supporting fingers 24 via the outer shaft tube 39 to the solid screen shaft 40 (FIG. 7) such that high and highest loads can be absorbed and dissipated.

The rotating teeth 34 of the screen disk 8 configured as a toothed disk 28 cause the deposited screening material to be agitated and conveyed in the longitudinal direction of the screening device 1. The cleaning tooth 11 causes cleaning of the clearances 7 between each of the screen disks.

Figure 9A:
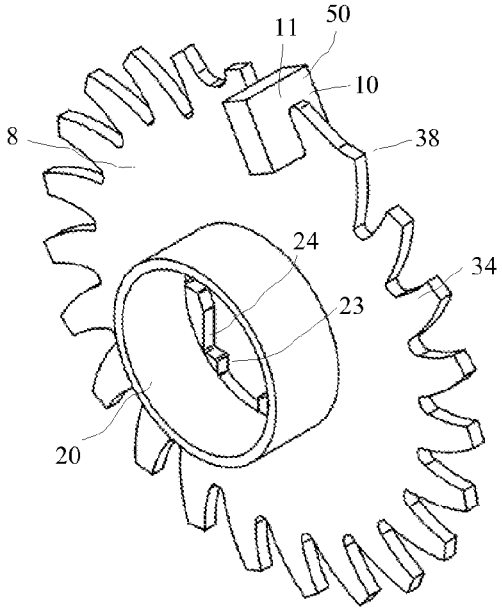
FIG. 9*a* a perspective view of a screen disk with a sleeve fastened thereto.

FIG. 9*a* shows a perspective view of the screen disk 8 in FIG. 8. The cleaning tooth 11 is configured extended both in the radial direction and in the axial direction and has an axial width that is somewhat less than is the axial distance between pairs of screen disks of a screen shaft. The lateral distance between the cleaning tooth 11 and the cleaned screen disk 8 or 9 is as a rule approximately 1 to 1.5 millimeters. The axial width of the cleaning tooth 11 is presently preferably between approximately 4 and 25 mm. The radial length is preferably more than 5 mm and may reach 10 mm or 20 mm.

The sleeve 20 is firmly connected with the screen disk 8 and for example welded thereto. When the entire screening device 1 is readily assembled the sleeve 20 is firmly connected with one screen disk 8 only, not with the axially adjacent screen disk. The sleeve 20 does not serve for positioning the screen disks 8 or 9 but only to prevent caking at the screen shafts 2-5.

Figure 9B:
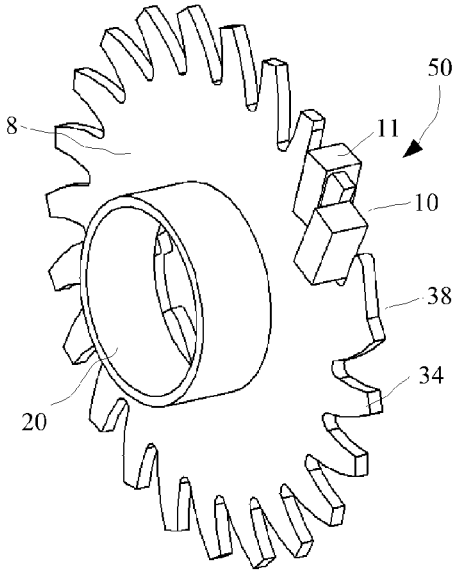
FIG. 9*b* a perspective view of another screen disk with a sleeve fastened thereto.

FIG. 9*b* is a perspective view of another screen disk 8. The present cleaning device 50 comprises two cleaning teeth 11 configured in a narrower axial width than the cleaning tooth 11 in FIG. 9*a*. Presently one cleaning tooth 11 substantially projects from or protrudes out of the screen disk 8 on one side only. In this way one cleaning tooth 11 will clean only about half of the clearance between pairs of screen disks 8 or 9 of adjacent screen shafts 2-5. This advantageously reduces the loads applied on the cleaning teeth 11 and thus wear of the cleaning teeth 11.

Since the cleaning teeth 11 supplement one another's axial width, the cleaning effect achieved is comparable to that of the single cleaning tooth 11 described above in FIG. 9*a*. The arrangement of the cleaning teeth 11 on the screen disk 8 in different angular positions allows foreign bodies more space for escaping from the clearance which likewise reduces loads on the cleaning teeth 11.

Figure 10:
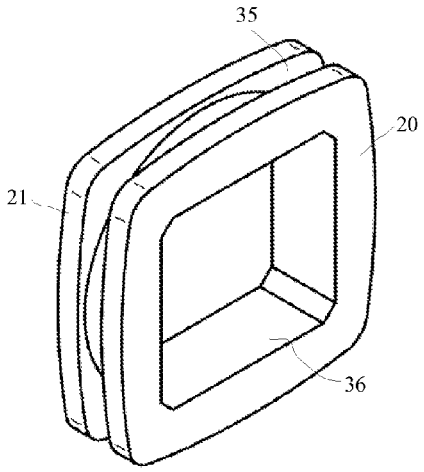
FIG. 10 a perspective view of another sleeve.
Figure 11:
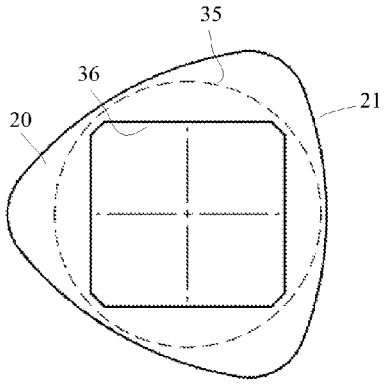
FIG. 11 a top view of another sleeve.

FIGS. 10 and 11 show further embodiments of the sleeves 20 being non-round in their outer cross-section. The outer contours 21 of the sleeves 20 according to FIG. 10 or 11 are matched to the movements of the cleaning tooth 11 so as to leave the smallest possible non-cleaned space for bakings.

Since adjacent screen shafts 2-5 of one screen unit 12 operate at different speeds of rotation, the relative point of entry of a cleaning tooth 11 into the respective clearance 7 changes with every rotation such that the clearance 7 is substantially cleaned over its entire circumference over time. The respective contours are illustrated in FIGS. 10 and 11 for the speed ratio of 3:4. In the presently shown exemplary embodiment the speeds of rotation of the screen shafts 2 to 5 are approximately 150 revolutions or 200 revolutions per minute. Higher and lower speeds are also conceivable.

Figure 12:
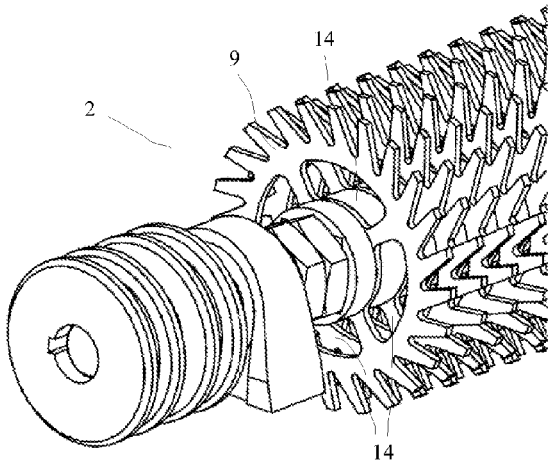
FIG. 12 a perspective view of an alternative screen shaft equipped with screen disks.

FIG. 12 shows an alternative configuration of a screen shaft with screen disks 9, the screen disks comprising through holes 14. The through holes 14 considerably reduce the total weight of the screening device 1. Moreover there is a smaller surface for the screened product to be caking.

On the whole an advantageous screening machine with an advantageous screening device is provided wherein intended cleaning of the clearances ensures a reliable continuous operation. Blocking due to caked screen feed can be largely avoided. Moreover assembly is facilitated since the screen disks 8 and 9 are attached in axially defined positions. The attaching of mounting aids allows defined positions. Moreover energy requirement is reduced.

The invention claimed is:

1. A screening device, comprising: multiple adjacent screen shafts disposed rotatably at each of which a plurality of screen disks of substantially rigid materials is disposed, wherein the screen disks are separated from one another in the axial direction by clearances and wherein screen disks of a screen shaft engage in clearances of the screen disks—of adjacent screen disks, approximately half of the screen disks are provided with at least one cleaning device for cleaning the clearances between the screen disks of adjacent screen shafts, and at least one screen shaft is provided with multiple mounting aids in defined positions in the axial direction.

2. The screening device according to claim 1 wherein the cleaning device comprises at least one extended cleaning tooth.

3. The screening device according to claim 1 wherein at least one screen unit is provided comprising multiple adjacent and in particular four adjacent screen shafts wherein only the screen disks of the two center screen shafts are provided with cleaning devices.

4. The screening device according to claim 3 wherein adjacent screen shafts of a screen unit rotate at different speeds in operation.

5. The screening device according to claim 3 wherein the speed ratio of two adjacent screen shafts of a screen unit lies between 7:6 and 5:2.

6. The screening device according to claim 3 wherein the screen shafts of a second screen unit rotate at rotational speeds different from those of the screen shafts of a first screen unit.

7. The screening device according to claim 1 wherein the screen disks and/or the cleaning teeth consist of metal and/or comprise an armored coat.

8. The screening device according to claim 1 wherein at least one screen disk comprises lateral recesses and/or axial through holes.

9. The screening device according to claim 1 wherein at least one screen shaft is configured as a multi-edge tube and in particular as a square tube on which the associated screen disks are attached.

10. The screening device according to claim 1 wherein the screen disks are retained in a defined way at the mounting aids by way of a bayonet joint and in particular are fixed by welding.

11. The screening device according to claim 1 wherein at least one sleeve is disposed in the clearance between pairs of screen disks of a screen shaft.

12. The screening device according to claim 1 wherein at least one screen disk is configured as a toothed disk.

13. The screening device according to claim 1 wherein the end shafts are not provided with cleaning devices.

14. The screening device according to claim 1, wherein screen disks of a screen shaft engage in the clearances of the screen disks of an adjacent screen shaft, in predefined axial positions of at least one screen shaft, at least one mounting aid each is disposed for defined mounting of the screen disks, wherein the axial positions on the screen shafts are defined by way of an integer multiple of an axial distance from a point of origin.

15. The screening device according to claim 14 wherein at least one mounting aid comprises at least one groove in the screen shaft.

16. The screening device according to claim 14 wherein at least one screen disk is provided with at least one holding finger and/or at least one supporting finger, the holding finger engaging the groove of the screen shaft and the supporting finger being configured and suitable as a radial safeguard on the screen shaft in the direction of loads.

17. The screening device according to claim 14 wherein the screen disk interacts with the mounting aid of the screen shaft by way of a bayonet joint.

18. A screening machine, comprising: at least one screening device according to claim 1.

19. A screening device, comprising: multiple adjacent screen shafts disposed rotatably at each of which a plurality of screen disks of substantially rigid materials is disposed, wherein the screen disks are separated from one another in the axial direction by clearances and wherein screen disks of a screen shaft engage in clearances of the screen disks of adjacent screen disks, approximately half of the screen disks are provided with at least one cleaning device for cleaning the clearances between the screen disks of adjacent screen shafts, at least one sleeve is disposed in the clearance between pairs of screen disks of a screen shaft and wherein an outer contour of at least one sleeve is matched to the movement profile of the cleaning teeth.

20. A screening device, comprising: multiple adjacent screen shafts disposed rotatably at each of which a plurality of screen disks of substantially rigid materials is disposed, wherein the screen disks are separated from one another in the axial direction by clearances and wherein screen disks of a screen shaft engage in clearances of the screen disks of adjacent screen disks, approximately half of the screen disks are provided with at least one cleaning device for cleaning the clearances between the screen disks of adjacent screen shafts, and wherein the screen disk has a deflector disposed at it preceding the cleaning device in the peripheral direction.

* * * * *